US008335684B2

(12) United States Patent
Thyssen et al.

(10) Patent No.: US 8,335,684 B2
(45) Date of Patent: Dec. 18, 2012

(54) INTERCHANGEABLE NOISE FEEDBACK CODING AND CODE EXCITED LINEAR PREDICTION ENCODERS

(75) Inventors: Jes Thyssen, Laguna Niguel, CA (US); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1108 days.

(21) Appl. No.: 11/773,039

(22) Filed: Jul. 3, 2007

(65) Prior Publication Data

US 2008/0015866 A1 Jan. 17, 2008

Related U.S. Application Data

(60) Provisional application No. 60/830,112, filed on Jul. 12, 2006.

(51) Int. Cl.
*G10L 19/12* (2006.01)

(52) U.S. Cl. ..... 704/222; 704/219; 704/230

(58) Field of Classification Search ..... 704/203, 704/219, 220, 221, 222, 223, 230
See application file for complete search history.

(56) References Cited

U.S. PATENT DOCUMENTS

| | | | | |
|---|---|---|---|---|
| 4,133,976 | A * | 1/1979 | Atal et al. | 704/226 |
| 5,077,798 | A * | 12/1991 | Ichikawa et al. | 704/222 |
| 5,206,884 | A * | 4/1993 | Bhaskar | 375/254 |
| 5,487,086 | A * | 1/1996 | Bhaskar | 375/243 |
| 5,493,296 | A * | 2/1996 | Sugihara | 341/76 |
| 5,752,222 | A * | 5/1998 | Nishiguchi et al. | 704/201 |
| 5,970,443 | A * | 10/1999 | Fujii | 704/222 |
| 5,999,899 | A * | 12/1999 | Robinson | 704/222 |
| 6,606,600 | B1 * | 8/2003 | Murgia et al. | 704/500 |
| 6,751,587 | B2 * | 6/2004 | Thyssen et al. | 704/228 |
| 6,829,579 | B2 * | 12/2004 | Jabri et al. | 704/221 |
| 6,885,988 | B2 * | 4/2005 | Chen | 704/228 |
| 6,980,951 | B2 * | 12/2005 | Chen | 704/222 |

(Continued)

FOREIGN PATENT DOCUMENTS

| | | |
|---|---|---|
| EP | 1326237 A2 | 7/2003 |
| EP | 1388845 A1 | 2/2004 |

OTHER PUBLICATIONS

Chen et al., "The Broadvoice Speech Coding Algorithm", IEEE International Conference on Acoustics, Speech and Signal Processing, 2007. ICASSP 2007, Apr. 15-20, 2007, vol. 4, IV-537 to IV-540.*

(Continued)

*Primary Examiner* — Martin Lerner
(74) *Attorney, Agent, or Firm* — Fiala & Weaver P.L.L.C.

(57) ABSTRACT

A system and method for encoding and decoding speech signals that includes a specially-designed Code Excited Linear Prediction (CELP) encoder and a vector quantization (VQ) based Noise Feedback Coding (NFC) decoder or that includes a specially-designed VQ-based NFC encoder and a CELP decoder. The VQ based NFC decoder may be a VQ based two-stage NFC (TSNFC) decoder. The specially-designed VQ-based NFC encoder may be a specially-designed VQ based TSNFC encoder. In each system, the encoder receives an input speech signal and encodes it to generate an encoded bit stream. The decoder receives the encoded bit stream and decodes it to generate an output speech signal. A system and method is also described in which a single decoder receives and decodes both CELP-encoded audio signals as well as VQ-based NFC-encoded audio signals.

20 Claims, 11 Drawing Sheets

U.S. PATENT DOCUMENTS

| | | | | |
|---|---|---|---|---|
| 7,110,942 | B2 * | 9/2006 | Thyssen et al. | 704/222 |
| 7,171,355 | B1 * | 1/2007 | Chen | 704/226 |
| 7,206,740 | B2 * | 4/2007 | Thyssen et al. | 704/222 |
| 7,209,878 | B2 * | 4/2007 | Chen | 704/222 |
| 7,496,506 | B2 * | 2/2009 | Chen | 704/226 |
| 7,522,586 | B2 * | 4/2009 | Unger | 370/356 |
| 2002/0077812 | A1 | 6/2002 | Suzuki et al. | |
| 2006/0136202 | A1 * | 6/2006 | Sengupta | 704/222 |
| 2010/0094637 | A1 * | 4/2010 | Vinton | 704/500 |
| 2011/0173004 | A1 * | 7/2011 | Bessette et al. | 704/500 |

OTHER PUBLICATIONS

Chen et al., "Novel Codec Structures for Noise Feedback Coding of Speech", 2006 IEEE International Conference on Acoustics, Speech and Signal Processing, 2006. ICASSP 2006, May 14-19, 2006, vol. 1, I-681 to I-684.*

Fazel et al., "Single and Double Frame Quantization of LSF Parameters Using Noise Feed-back Coding", IEEE International Conference on Communications, 2001. ICC 2001, Jun. 11, 2001 to Jun. 14, 2001, vol. 8, pp. 2449 to 2452.*

Chen, J., "Novel Codec Structures for Noise Feedback Coding of Speech", Acoustics, Speech and signal Processing, ICASSP 2006 Proceedings. 2006 IEEE International Conference on Toulouse,(May 14, 2006), pp. I-681-I-684.

Yoon, S. et al., "Transcoding Algorithm for G.723.1 and AMR Speech Coders: for Interoperability between VoIP and Mobile Networks1", EUROSPEECH, Sep. 2003, pp. 1101-1104.

* cited by examiner

INTERCHANGEABLE NOISE FEEDBACK CODING AND CODE EXCITED LINEAR PREDICTION ENCODERS

CROSS-REFERENCE TO RELATED APPLICATIONS

This application claims priority to U.S. Provisional Patent Application No. 60/830,112, filed Jul. 12, 2006, the entirety of which is incorporated by reference herein.

BACKGROUND OF THE INVENTION

1. Field of the Invention

The present invention relates to a system for encoding and decoding speech and/or audio signals.

2. Background

In the last two decades, the Code Excited Linear Prediction (CELP) technique has been the most popular and dominant speech coding technology. The CELP principle has been subject to intensive research in terms of speech quality and efficient implementation. There are hundreds, perhaps even thousands, of CELP research papers published in the literature. In fact, CELP has been the basis of most of the international speech coding standards established since 1988.

Recently, it has been demonstrated that two-stage noise feedback coding (TSNFC) based on vector quantization (VQ) can achieve competitive output speech quality and codec complexity when compared with CELP coding. BroadVoice® 16 (BV16), developed by Broadcom Corporation of Irvine Calif., is a VQ-based TSNFC codec that has been standardized by CableLabs® as a mandatory audio codec in the PacketCable™ 1.5 standard for cable telephony. BV16 is also an SCTE (Society of Cable Telecommunications Engineers) standard, an ANSI American National Standard, and is a recommended codec in the ITU-T Recommendation J.161 standard. Furthermore, both BV16 and BroadVoice®32 (BV32), another VQ-based TSNFC codec developed by Broadcom Corporation of Irvine Calif., are part of the PacketCable™ 2.0 standard. An example VQ-based TSNFC codec is described in commonly-owned U.S. Pat. No. 6,980,951 to Chen, issued Dec. 27, 2005 (the entirety of which is incorporated by reference herein).

CELP and TSNFC are considered to be very different approaches to speech coding. Accordingly, systems for coding speech and/or audio signals have been built around one technology or the other, but not both. However, there are potential advantages to be gained from using a CELP encoder to interoperate with a TSNFC decoder such as the BV16 or BV32 decoder or using a TSNFC encoder to interoperate with a CELP decoder. There currently appears to be no solution for achieving this.

SUMMARY OF THE INVENTION

As described in more detail herein, the present invention provides a system and method by which a Code Excited Linear Prediction (CELP) encoder may interoperate with a vector quantization (VQ) based noise feedback coding (NFC) decoder, such as a VQ-based two-stage NFC (TSNFC) decoder, and by which a VQ-based NFC encoder, such as a VQ-based TSNFC encoder may interoperate with a CELP decoder. Furthermore, the present invention provides a system and method by which a CELP encoder and a VQ-based NFC encoder may both interoperate with a single decoder.

In particular, a method for decoding an audio signal in accordance with an embodiment of the present invention is described herein. In accordance with the method, an encoded bit stream is received. The encoded bit stream represents an input audio signal, such as an input speech signal, encoded by a CELP encoder. The encoded bit stream is then decoded using a VQ-based NFC decoder, such as a VQ-based TSNFC decoder, to generate an output audio signal, such as an output speech signal. The method may further include first receiving the input audio signal and encoding the input audio signal using a CELP encoder to generate the encoded bit stream.

A system for communicating an audio signal in accordance with an embodiment of the present invention is also described herein. The system includes a CELP encoder and a VQ-based NFC decoder. The CELP encoder is configured to encode an input audio signal, such as an input speech signal, to generate an encoded bit stream. The VQ-based NFC decoder is configured to decode the encoded bit stream to generate an output audio signal, such as an output speech signal. The VQ-based NFC decoder may comprise a VQ-based TSNFC decoder.

An alternative method for decoding an audio signal in accordance with an embodiment of the present invention is also described herein. In accordance with the method, an encoded bit stream is received. The encoded bit stream represents an input audio signal, such as an input speech signal, encoded by a VQ-based NFC encoder, such as a VQ-based TSNFC encoder. The encoded bit stream is then decoded using a CELP decoder to generate an output audio signal, such as an output speech signal. The method may further include first receiving the input audio signal and encoding the input audio signal using a VQ-based NFC encoder to generate the encoded bit stream.

An alternative system for communicating an audio signal in accordance with an embodiment of the present invention is further described herein. The system includes a VQ-based NFC encoder and a CELP decoder. The VQ-based NFC encoder is configured to encode an input audio signal, such as an input speech signal, to generate an encoded bit stream. The CELP decoder is configured to decode the encoded bit stream to generate an output audio signal, such as an output speech signal. The VQ-based NFC encoder may comprise a VQ-based TSNFC encoder.

A method for decoding audio signals in accordance with a further embodiment of the present invention is also described herein. In accordance with the method, a first encoded bit stream is received. The first encoded bit stream represents a first input audio signal encoded by a CELP encoder. The first encoded bit stream is decoded in a decoder to generate a first output audio signal. A second encoded bit stream is also received. The second encoded bit stream represents a second input audio signal encoded by a VQ-based NFC encoder, such as a VQ-based TSNFC encoder. The second encoded bit stream is also decoded in the decoder to generate a second output audio signal. The first and second input audio signals may comprise input speech signals and the first and second output audio signals may comprise output speech signals.

A system for communicating audio signals in accordance with an embodiment of the present invention is also described herein. The system includes a CELP encoder, a VQ-based NFC encoder, and a decoder. The CELP encoder is configured to encode a first input audio signal to generate a first encoded bit stream. The VQ-based NFC encoder is configured to encode a second input audio signal to generate a second encoded bit stream. The decoder is configured to decode the first encoded bit stream to generate a first output audio signal and to decode the second encoded bit stream to generate a second output audio signal. The first and second input audio signals may comprise input speech signals and the first and second output audio signals may comprise output speech signals. The VQ-based NFC encoder may comprise a VQ-based TSNFC encoder.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form a part of the specification, illustrate one or more embodiments of the present invention and, together with the description, further serve to explain the purpose, advantages, and principles of the invention and to enable a person skilled in the art to make and use the invention.

Figure 1:
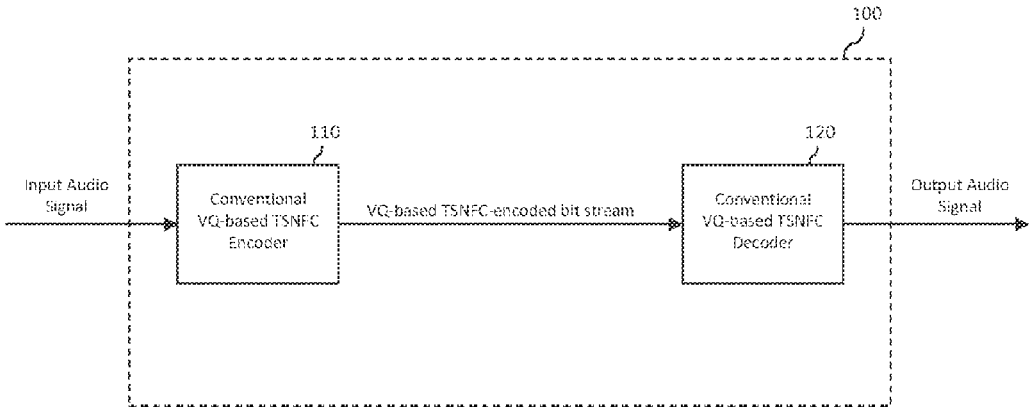
FIG. 1 (PRIOR ART)
FIG. 1 is a block diagram of a conventional audio encoding and decoding system that includes a conventional vector quantization (VQ) based two-stage noise feedback coding (TSNFC) encoder and a conventional VQ-based TSNFC decoder.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF INVENTION

A. Overview

Although the encoder structures associated with Code Excited Linear Prediction (CELP) and vector quantization (VQ) based two-stage noise feedback coding (TSNFC) are significantly different, embodiments of the present invention are premised on the insight that the corresponding decoder structures of the two can actually be the same. Generally speaking, the task of a CELP encoder or TSNFC encoder is to derive and quantize, on a frame-by-frame basis, an excitation signal, an excitation gain, and parameters of a long-term predictor and a short-term predictor. Assuming that a CELP decoder and a TSNFC decoder can be the same, given a particular TSNFC decoder structure, such as the decoder structure associated with BV16, it is therefore possible to design a CELP encoder that will achieve the same goals as a TSNFC encoder-namely, to derive and quantize an excitation signal, an excitation gain, and predictor parameters in such a way that the TSNFC decoder can properly decode a bit stream compressed by such a CELP encoder. In other words, it is possible to design a CELP encoder that is compatible with a given TSNFC decoder.

Figure 2:
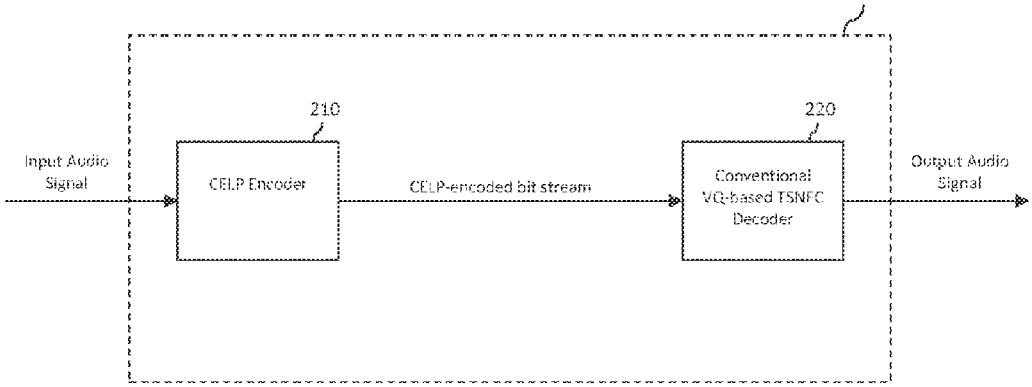
FIG. 2 is a block diagram of an audio encoding and decoding system in accordance with an embodiment of the present invention that includes a Code Excited Linear Prediction (CELP) encoder and a conventional VQ-based TSNFC decoder.

This concept is illustrated in FIG. 1 and FIG. 2. In particular, FIG. 1 is a block diagram of a conventional audio encoding and decoding system 100 that includes a conventional VQ-based TSNFC encoder 110 and a conventional VQ-based TSNFC decoder 120. Encoder 110 is configured to compress an input audio signal, such as an input speech signal, to produce a VQ-based TSNFC-encoded bit stream. Decoder 120 is configured to decode the VQ-based TSNFC-encoded bit stream to produce an output audio signal, such as an output speech signal. Encoder 110 and decoder 120 could be embodied in, for example, a BroadVoice®16 (BV16) codec or a BroadVoice®32 (BV32) codec, developed by Broadcom Corporation of Irvine Calif.

FIG. 2 is a block diagram of an audio encoding and decoding system 200 in accordance with an embodiment of the present invention that is functionally equivalent to conventional system 100 of FIG. 1. In system 200, conventional VQ-based TSNFC decoder 220 is identical to conventional VQ-based TSNFC decoder 120 of system 100. However, conventional VQ-based TSNFC encoder 110 has been replaced by a CELP encoder 210 that has been specially designed in accordance with an embodiment of the present invention to be compatible with VQ-based TSNFC decoder 220. Since a CELP decoder can be identical to a VQ-based TSNFC decoder, it is possible to treat VQ-based TSNFC decoder 220 as a CELP decoder, and then design a CELP encoder 210 that will interoperate with decoder 220.

Embodiments of the present invention are also premised on the insight that given a particular CELP decoder, such as a decoder of the ITU-T Recommendation G.723.1, it is also possible to design a VQ-based TSNFC encoder that can produce a bit stream that is compatible with the given CELP decoder.

Figure 3:
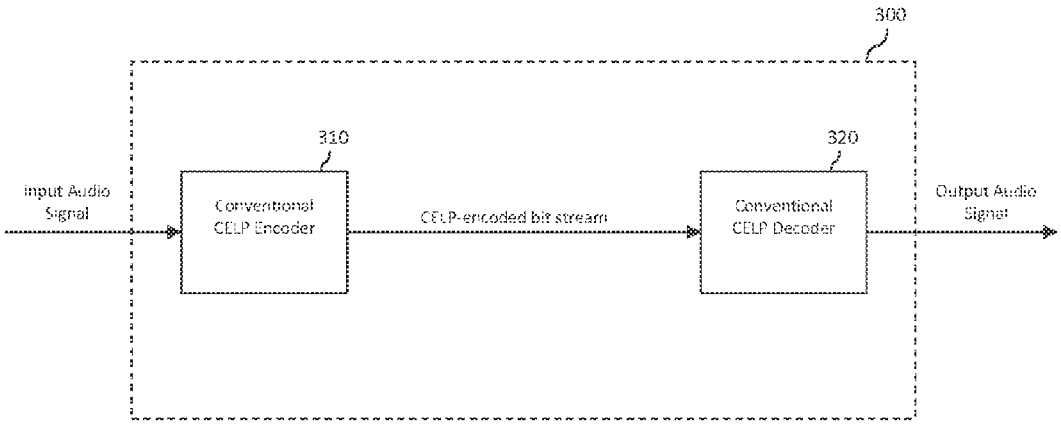
FIG. 3 (PRIOR ART)
FIG. 3 is a block diagram of a conventional audio encoding and decoding system that includes a conventional CELP encoder and a conventional CELP decoder.
Figure 4:
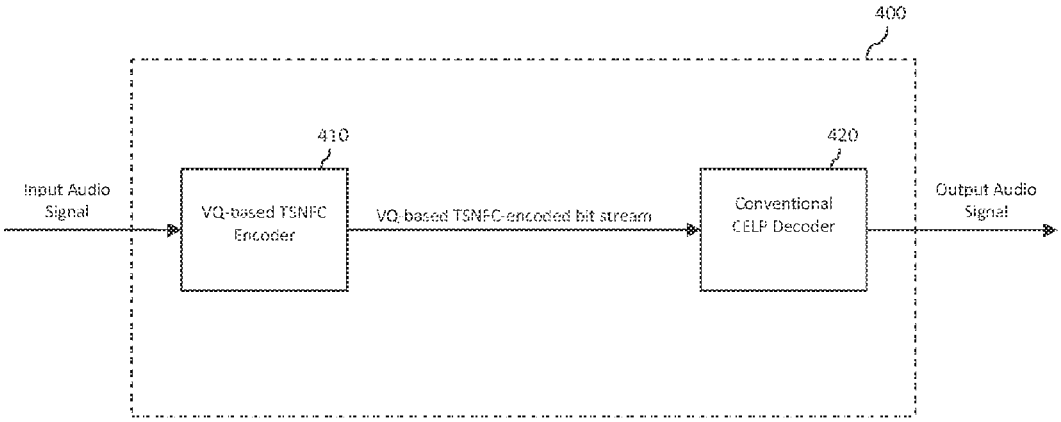
FIG. 4 is a block diagram of an audio encoding and decoding system in accordance with an embodiment of the present invention that includes a VQ-based TSNFC encoder and a conventional CELP decoder.

This concept is illustrated in FIG. 3 and FIG. 4. In particular, FIG. 3 is a block diagram of a conventional audio encoding and decoding system 300 that includes a conventional CELP encoder 310 and a conventional CELP decoder 320. Encoder 310 is configured to compress an input audio signal, such as an input speech signal, to produce a CELP-encoded bit stream. Decoder 320 is configured to decode the CELP-encoded bit stream to produce an output audio signal, such as an output speech signal. Encoder 310 and decoder 320 could be embodied in, for example, an ITU-T G.723.1 codec.

FIG. 4 is a block diagram of an audio encoding and decoding system 400 in accordance with an embodiment of the present invention that is functionally equivalent to conventional system 300 of FIG. 3. In system 400, conventional CELP decoder 420 is identical to conventional CELP decoder 320 of system 300. However, conventional CELP encoder 310 has been replaced by a VQ-based TSNFC encoder 410 that has been specially designed in accordance with an embodiment of the present invention to be compatible with CELP decoder 420. Since a VQ-based TSNFC decoder can be identical to a CELP decoder, it is possible to treat CELP decoder 420 as a VQ-based TSNFC decoder, and then design a VQ-based TSNFC encoder 410 that will interoperate with decoder 420.

One potential advantage of using a CELP encoder to interoperate with a TSNFC decoder such as the BV16 or BV32 decoder is that during the last two decades there has been intensive research on CELP encoding techniques in terms of quality improvement and complexity reduction. Therefore, using a CELP encoder may enable one to reap the benefits of such intensive research. On the other hand, using a TSNFC encoder may provide certain benefits and advantages depending upon the situation. Thus, the present invention can have substantial benefits and values.

It should be noted that while the above embodiments are described as using VQ-based TSNFC encoders and decoders, the present invention may also be implemented using an existing VQ-based single-stage NFC decoder (with reference to the embodiment of FIG. 2) or a specially-designed VQ-based single-stage NFC encoder (with reference to the embodiment of FIG. 4). Thus, for example, in one embodiment of the present invention, a specially-designed VQ-based single-stage NFC encoder may be used in conjunction with an ITU-T Recommendation G.728 Low-Delay CELP decoder. As will be appreciated by persons skilled in the relevant art(s), the G.728 codec is a single-stage predictive codec that uses only a short-term predictor and does not use a long-term predictor.

B. Implementation Details in Accordance with Example Embodiments of the Present Invention A primary difference between CELP and TSNFC encoders lies in how each encoder is configured to encode and quantize an excitation signal. While each approach may favor a different excitation structure, there is an overlap, and nothing to prevent the encoding and quantization processes from being used interchangeably. The core functional blocks used for performing these processes, such as the functional blocks used for performing pre-filtering, estimation, and quantization of Linear Predictive Coding (LPC) coefficients, pitch period estimation, and so forth, are all shareable.

Figure 5:
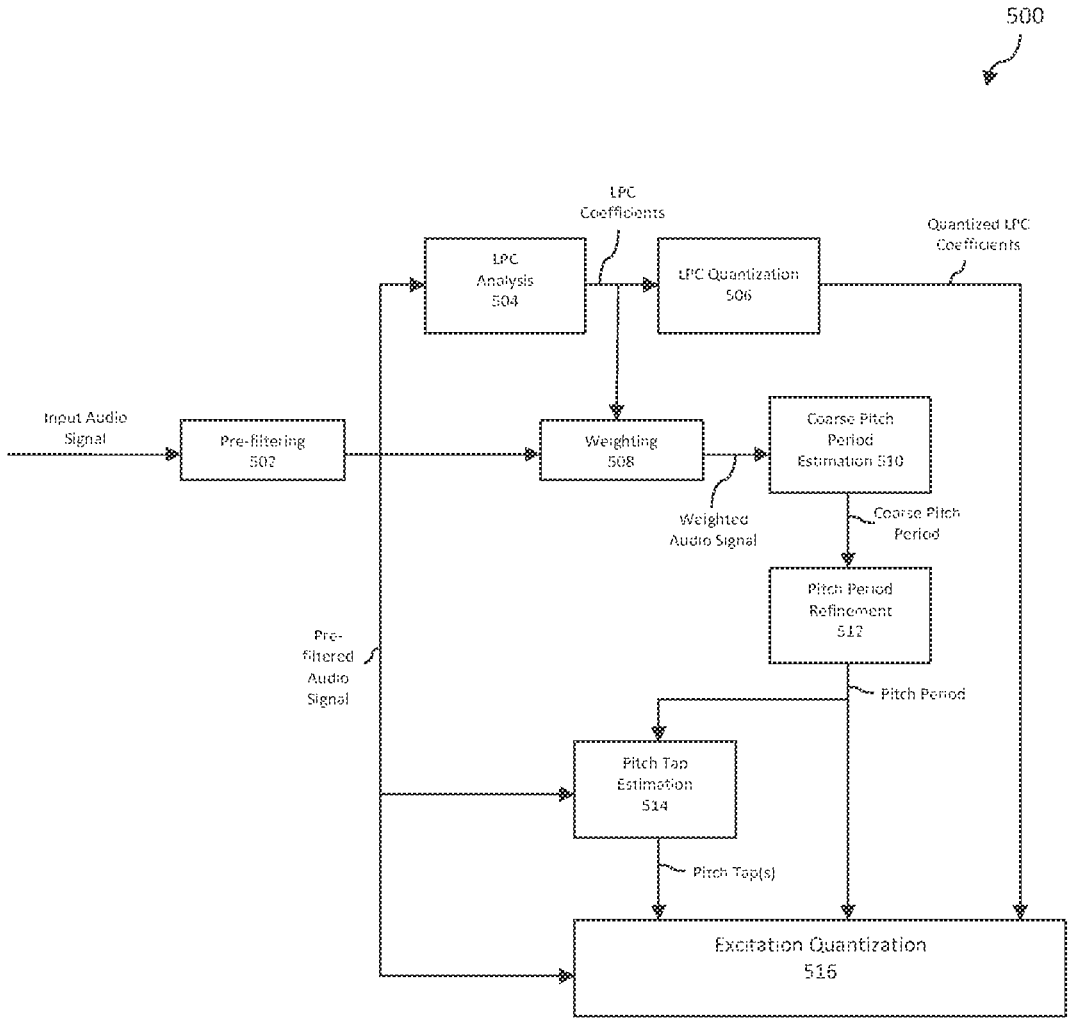
FIG. 5 is a functional block diagram of a system used for encoding and quantizing an excitation signal based on an input audio signal in accordance with an embodiment of the present invention.

This concept is illustrated in FIG. 5, which shows functional blocks of a system 500 used for encoding and quantizing an excitation signal based on an input audio signal in accordance with an embodiment of the present invention. As will be explained in more detail below, depending on how system 500 is configured, it may be used to implement CELP encoder 210 of system 200 as described above in reference to FIG. 2 or VQ-based TSNFC encoder 410 of system 400 as described above in reference to FIG. 4.

As shown in FIG. 5, system 500 includes a pre-filtering block 502, an LPC analysis block 504, an LPC quantization block 506, a weighting block 508, a coarse pitch period estimation block 510, a pitch period refinement block 512, a pitch tap estimation block 514, and an excitation quantization block 516. The manner in which each of these blocks operates will now be briefly described.

Pre-filtering block 502 is configured to receive an input audio signal, such as an input speech signal, and to filter the input audio signal to produce a pre-filtered version of the input audio signal. LPC analysis block 504 is configured to receive the pre-filtered version of the input audio signal and to produce LPC coefficients therefrom. LPC quantization block 506 is configured to receive the LPC coefficients from LPC analysis block 504 and to quantize them to produce quantized LPC coefficients. As shown in FIG. 5, these quantized LPC coefficients are provided to excitation quantization block 516.

Weighting block 508 is configured to receive the pre-filtered audio signal and to produce a weighted audio signal, such as a weighted speech signal, therefrom. Coarse pitch period estimation block 510 is configured to receive the weighted audio signal and to select a coarse pitch period based on the weighted audio signal. Pitch period refinement block 512 is configured to receive the coarse pitch period and to refine it to produce a pitch period. Pitch tap estimation block 514 is configured to receive the pre-filtered audio signal and the pitch period and to produce one or more pitch tap(s) based on those inputs. As is further shown in FIG. 5, both the pitch period and the pitch tap(s) are provided to excitation quantization block 516.

Persons skilled in the relevant art(s) will be very familiar with the functions of each of blocks 502, 504, 506, 508, 510, 512, 514 and 516 as described above and will capable of implementing such blocks.

Excitation quantization block 516 is configured to receive the pre-filtered audio signal, the quantized LPC coefficients, the pitch period, and the pitch tap(s). Excitation quantization block 516 is further configured to perform the encoding and quantization of an excitation signal based on these inputs. In accordance with embodiments of the present invention, excitation quantization block 516 may be configured to perform excitation encoding and quantization using a CELP technique (e.g., in the instance where system 500 is part of CELP encoder 210) or to perform excitation encoding and quantization using a TSNFC technique (e.g., in the instance where system 500 is part of VQ-based TSNFC encoder 410). In principle, however, alternative techniques could be used. For example, one alternative is to obtain the excitation signal through open-loop quantization of a long-term prediction residual.

Figure 8:
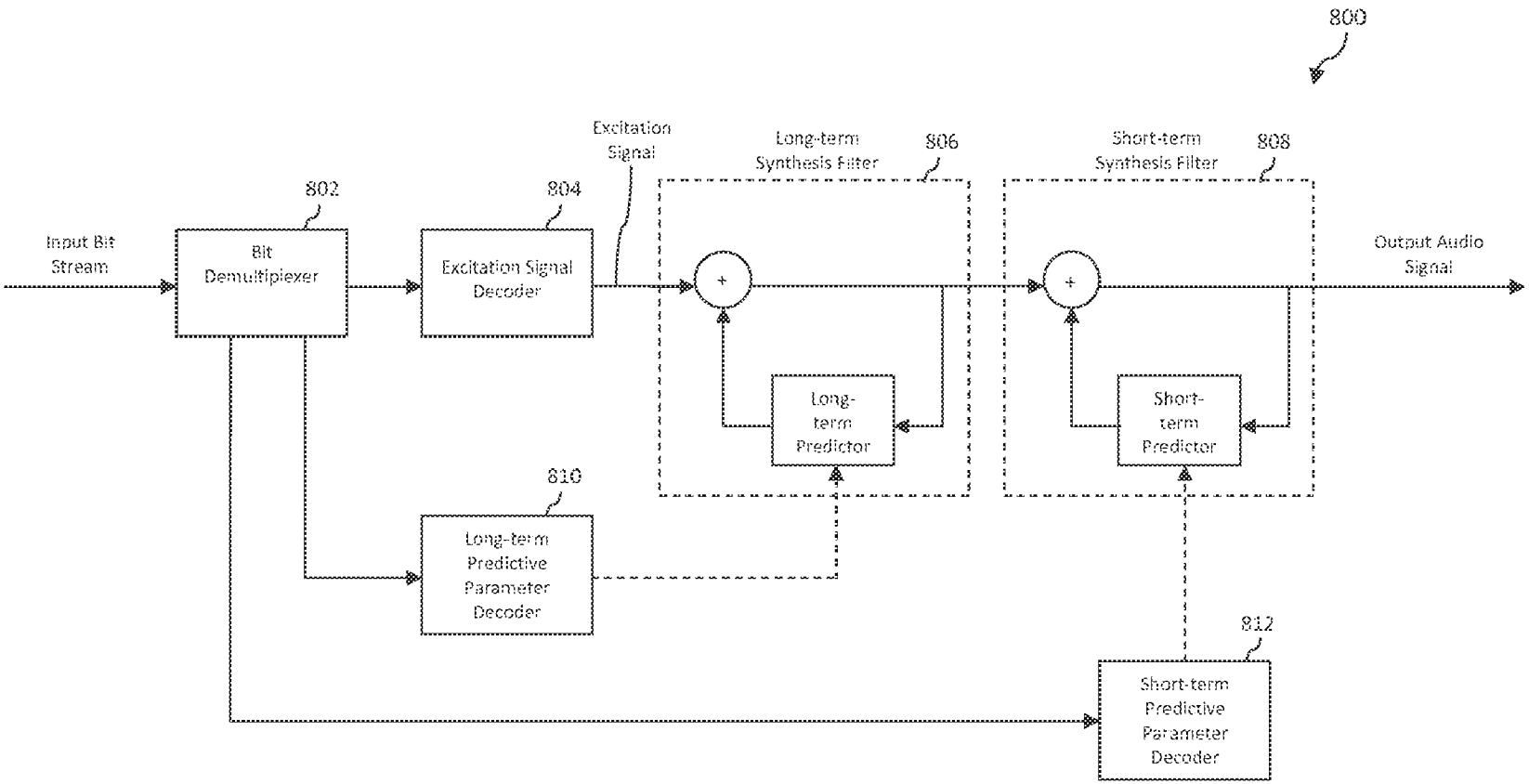
FIG. 8 is a block diagram of a generic decoder structure that may be used to implement the present invention.

In any case, the structure of the excitation signal (i.e., the modeling of the long-term prediction residual) is dictated by the decoder structure and bit-stream definition and cannot be altered. An example of a generic decoder structure 800 in accordance with an embodiment of the present invention is shown in FIG. 8 and will be described in more detail below.

As will be appreciated by persons skilled in the relevant art(s), the estimation and selection of the excitation signal parameters in the encoder can be carried out in any of a variety of ways by excitation quantization block 516. The quality of the reconstructed speech signal will depend largely on the methods used for this excitation quantization. Both TSNFC and CELP have proven to provide high quality at reasonable complexity, while an entirely open-loop approach would generally have less complexity but provide lower quality.

Note that, in some cases, functional blocks shown outside of excitation quantization block 516 in FIG. 5 are considered part of the excitation quantization in the sense that parameters are optimized and/or quantized jointly with the excitation quantization. Most notably, pitch-related parameters are sometimes estimated and/or quantized either partly or entirely in conjunction with the excitation quantization. Accordingly, persons skilled in the relevant art(s) will appreciated that the present invention is not limited to the particular arrangement and definition of functional blocks set forth in FIG. 5 but is also applicable to other arrangements and definitions.

Figure 6:
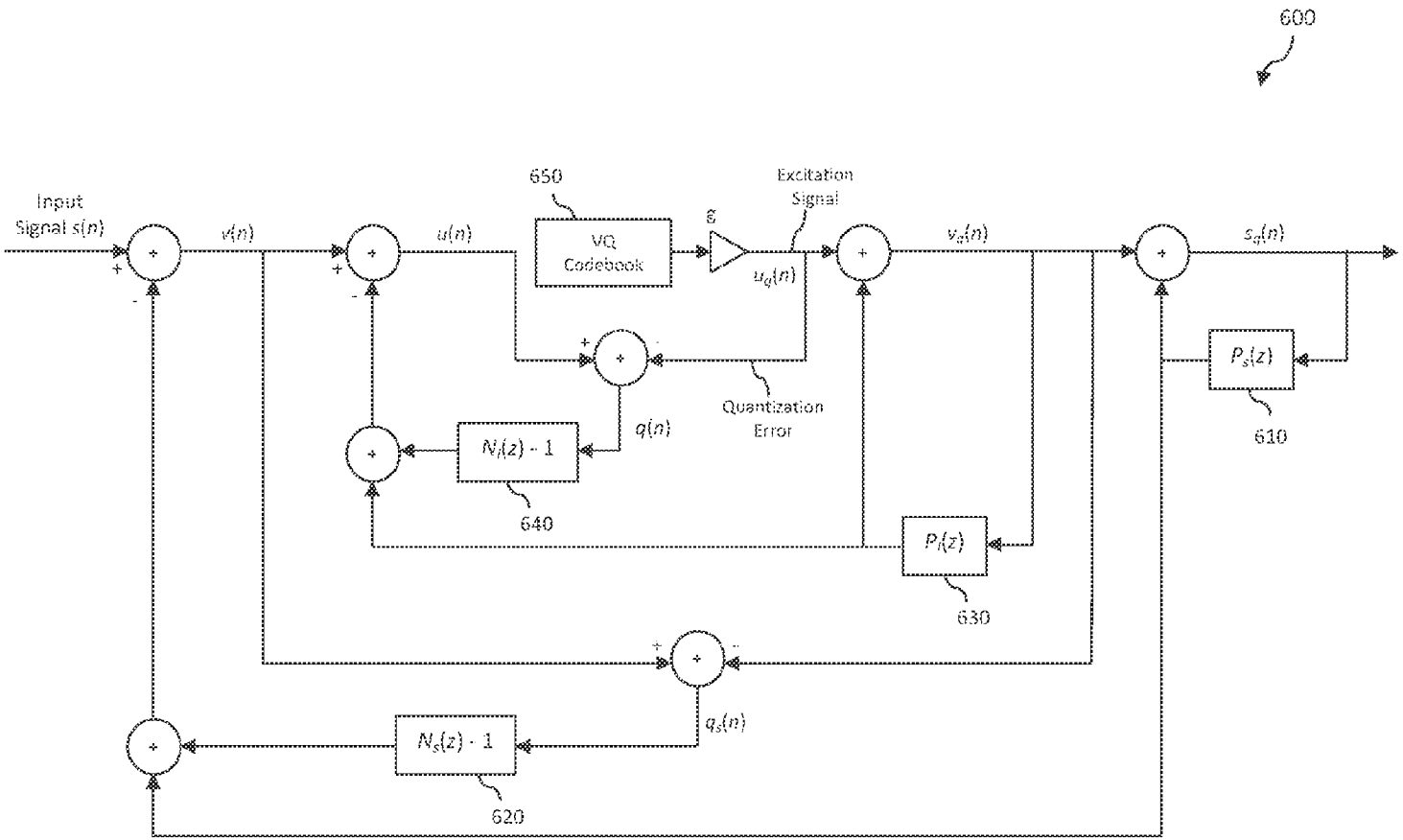
FIG. 6 is a block diagram of the structure of an example excitation quantization block in a TSNFC encoder in accordance with an embodiment of the present invention.
Figure 7:
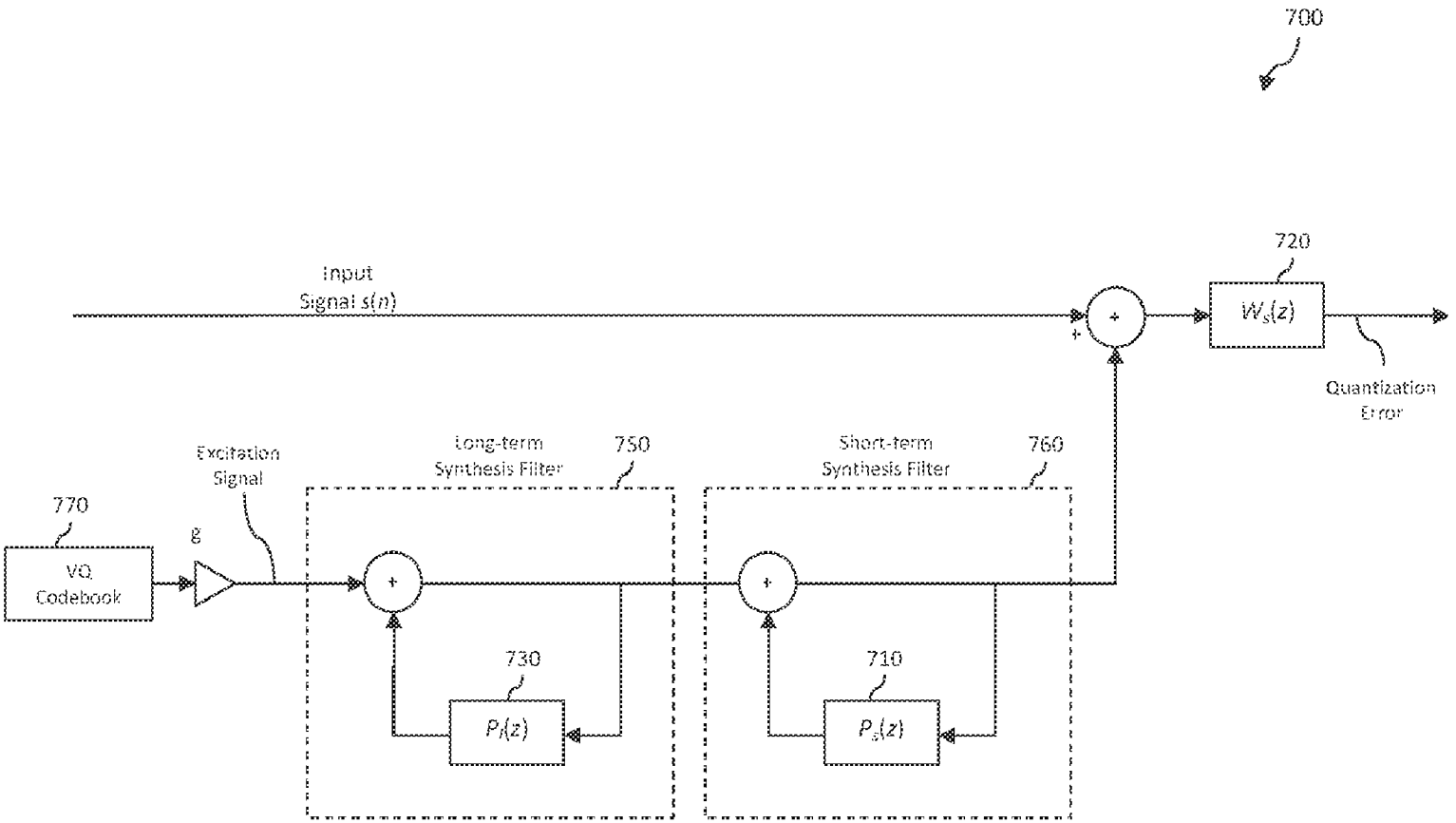
FIG. 7 is a block diagram of the structure of an example excitation quantization block in a CELP encoder in accordance with an embodiment of the present invention.

FIG. 6 depicts the structure 600 of an example excitation quantization block 600 in a TSNFC encoder in accordance with an embodiment of the present invention, while FIG. 7 depicts the structure 700 of an example excitation quantization block in a CELP encoder in accordance with an embodiment of the present invention. Either of these structures may be used to implement excitation quantization block 516 of system 500.

At first, the differences between structure 600 of FIG. 6 and structure 700 of FIG. 7 may seem to rule out any interchanging. However, the fact that the high level blocks of the corresponding decoders may have a very similar, if not identical, structure (such as the structure depicted in FIG. 8) provides an indication that interchanging should be possible. Still, the creation of an interchangeable design is non-trivial and requires some consideration.

Structure 600 of FIG. 6 is configured to perform one type of TSNFC excitation quantization. This type achieves a short-term shaping of the overall quantization noise according to $N_s(z)$, see block 620, and a long-term shaping of the quantization noise according to $N_l(z)$, see block 640. The LPC (short-term) predictor is given in block 610, and the pitch (long-term) predictor is in block 630. The manner in which structure 600 operates is described in full in U.S. Pat. No. 7,171,355, entitled "Method and Apparatus for One-Stage and Two-Stage Noise Feedback Coding of Speech and Audio Signals" issued Jan. 30, 2007, the entirety of which is incorporated by reference herein. That description will not be repeated herein for the sake of brevity.

Structure 700 of FIG. 7 depicts one example of a structure that performs CELP excitation quantization. Structure 700 achieves short-term shaping of the quantization noise according to $1/W_s(z)$, see block 720, but it does not perform long-term shaping of the quantization noise. In CELP terminology, the filter $W_s(z)$ is often referred to as the "perceptual weighting filter." Long-term shaping of the quantization noise has been omitted since it is commonly not performed with CELP quantization of the excitation signal. However, it can be achieved by adding a long-term weighting filter in series with $W_s(z)$. The short term predictor is shown in block 710, and the long-term predictor is shown in block 730. Note that these predictors correspond to those in blocks 610 and 630, respectively, in structure 600 of FIG. 6. The manner in which structure 700 operates to perform CELP excitation quantization is well known to persons skilled in the relevant art(s) and need not be further described herein.

The task of the excitation quantization in FIGS. 6 and 7 is to select an entry from a VQ codebook (VQ codebook 650 in FIG. 6 and VQ codebook 770 in FIG. 7, respectively), but it could also include selecting the quantized value of the excitation gain, denoted "g". For the sake of simplicity, this parameter is assumed to be quantized separately in structure 600 of FIG. 6 and structure 700 of FIG. 7. In both FIG. 6 and FIG. 7, the selection of a vector from the VQ codebook is typically done by minimizing the mean square error (MSE) of the quantization error, q(n), over the input vector length. If the same VQ codebook is used in the TSNFC and CELP encoders, and the blocks outside the excitation quantization are identical, then the two encoders will provide compatible bitstreams even though the two excitation quantization processes are fundamentally different. Furthermore, both bitstreams would be compatible with either the TSNFC decoder or CELP decoder.

Although the invention is described above with the particular example TSNFC and CELP structures of FIGS. 6 and 7, respectively, it is to be understood that it applies to all variations of TSNFC, NFC and CELP. As mentioned above, the excitation quantization could even be replaced with other methods used to quantize the excitation signal. A particular example of open-loop quantization of the pitch prediction residual was mentioned above.

FIG. 8 depicts a generic decoder structure 800 that may be used to implement the present invention. The invention however is not limited to the decoder structure of FIG. 8 and other suitable structures may be used.

As shown in FIG. 8, decoder structure 800 includes a bit demultiplexer 802 that is configured to receive an input bit stream and selectively output encoded bits from the bit stream to an excitation signal decoder 804, a long-term predictive parameter decoder 810, and a short-term predictive parameter decoder 812. Excitation signal decoder 804 is configured to receive encoded bits from bit demultiplexer 802 and decode an excitation signal therefrom. Long-term predictive parameter decoder 810 is configured to receive encoded bits from bit demultiplexer 802 and decode a pitch period and pitch tap(s) therefrom. Short-term predictive parameter decoder 812 is configured to receive encoded bits from bit demultiplexer 802 and decode LPC coefficients therefrom. Long-term synthesis filter 806, which corresponds to the pitch synthesis filter, is configured to receive the excitation signal and to filter the signal in accordance with the pitch period and pitch tap(s). Short-term synthesis filter 808, which corresponds to the LPC synthesis filter, is configured to receive the filtered excitation signal from the long-term synthesis filter 806 and to filter the signal in accordance with the LPC coefficients. The output of the short-term synthesis filter 808 is the output audio signal.

C. Methods in Accordance with Embodiments of the Present Invention

This section will describe various methods that may be implemented in accordance with an embodiment of the present invention. These methods are presented herein by way of example only and are not intended to limit the present invention.

Figure 9:
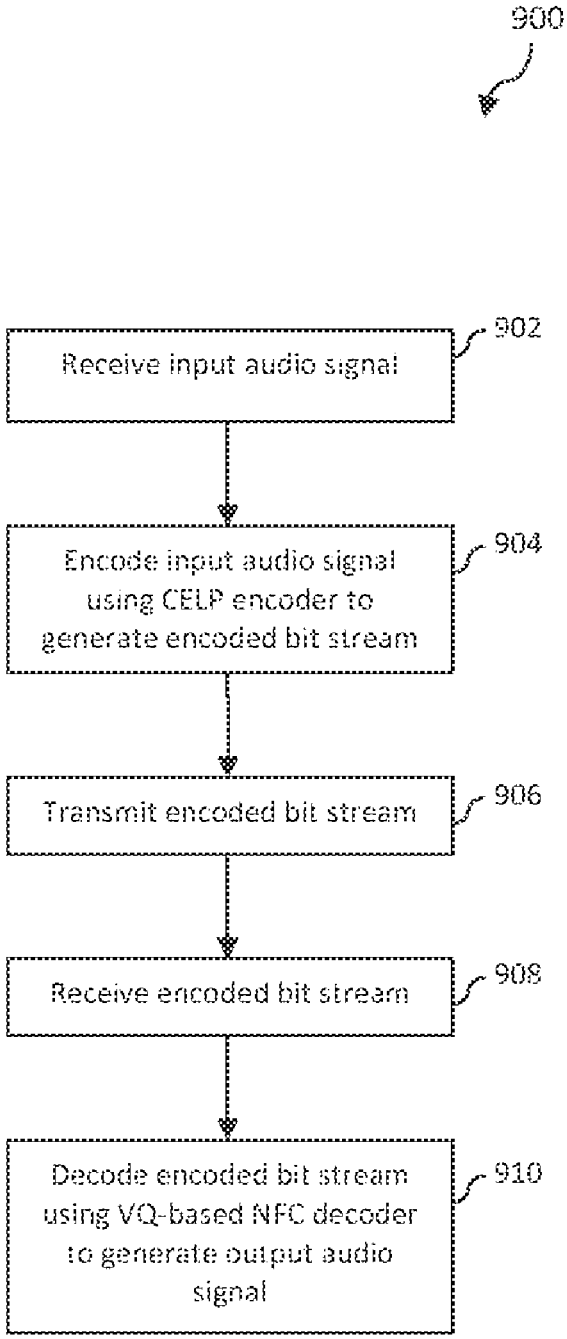
FIG. 9 is a flowchart of a method for communicating an audio signal, such a speech signal, in accordance with an embodiment of the present invention.

FIG. 9 is a flowchart 900 of a method for communicating an audio signal, such a speech signal, in accordance with an embodiment of the present invention. The method of flowchart 900 may be performed, for example, by system 200 depicted in FIG. 2.

As shown in FIG. 9, the method of flowchart 900 begins at step 902 in which an input audio signal, such as an input speech signal, is received by a CELP encoder. At step 904, the CELP encoder encodes the input audio signal to generate an encoded bit stream. Like CELP encoder 210 of FIG. 2, the CELP encoder is specially designed to be compatible with a VQ-based NFC decoder. Thus, the bit stream generated in step 904 is capable of being received and decoded by a VQ-based NFC decoder.

At step 906, the encoded bit stream is transmitted from the CELP encoder. At step 908, the encoded bit stream is received by a VQ-based NFC decoder. The VQ-based NFC decoder may be, for example, a VQ-based TSNFC decoder. At step 910, the VQ-based NFC decoder decodes the encoded bit stream to generate an output audio signal, such as an output speech signal.

Figure 10:
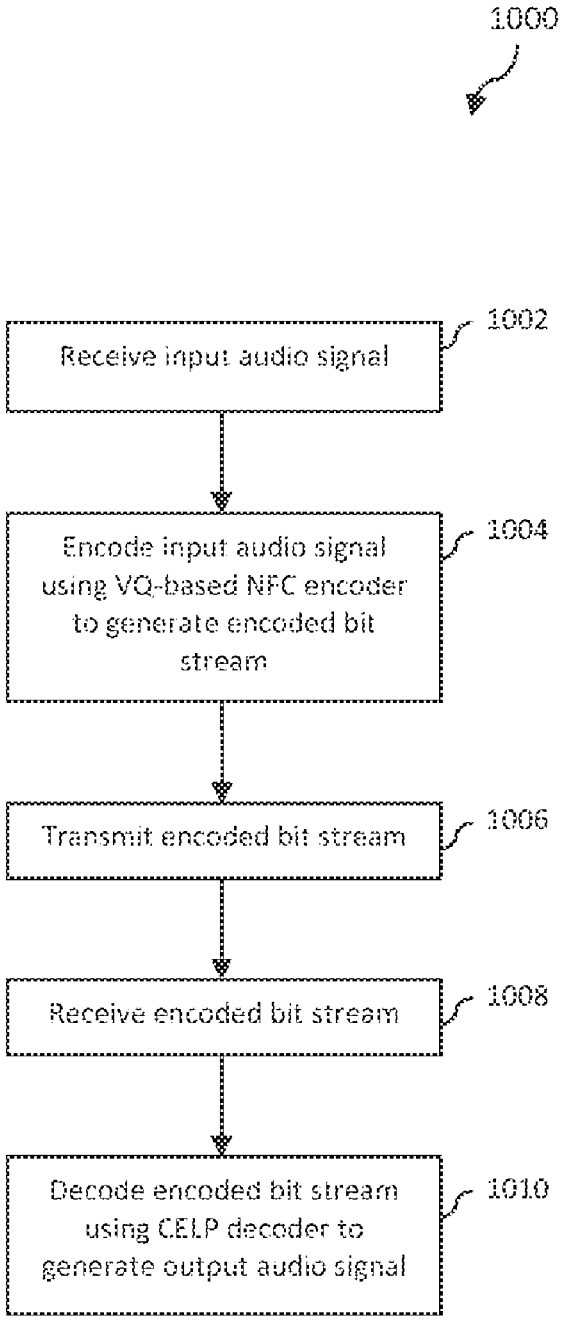
FIG. 10 is a flowchart of a method for communicating an audio signal, such a speech signal, in accordance with an alternate embodiment of the present invention.

FIG. 10 is a flowchart 1000 of an alternate method for communicating an audio signal, such a speech signal, in accordance with an embodiment of the present invention. The method of flowchart 1000 may be performed, for example, by system 400 depicted in FIG. 4.

As shown in FIG. 10, the method of flowchart 1000 begins at step 1002 in which an input audio signal, such as an input speech signal, is received by a VQ-based NFC encoder. The VQ-based NFC encoder may be, for example, a VQ-based TSNFC encoder. At step 1004, the VQ-based NFC encoder encodes the input audio signal to generate an encoded bit stream. Like VQ-based NFC encoder 410 of FIG. 4, the VQ-based NFC encoder is specially designed to be compatible with a CELP decoder. Thus, the bit stream generated in step 1004 is capable of being received and decoded by a CELP decoder.

At step 1006, the encoded bit stream is transmitted from the VQ-based NFC encoder. At step 1008, the encoded bit stream is received by a CELP decoder. At step 1010, the CELP decoder decodes the encoded bit stream to generate an output audio signal, such as an output speech signal.

In accordance with the principles of the present invention, and as described in detail above, in one embodiment of the present invention a single generic decoder structure can be used to receive and decode audio signals that have been encoded by a CELP encoder as well as audio signals that have been encoded by a VQ-based NFC encoder. Such an embodiment is depicted in FIG. 11.

Figure 11:
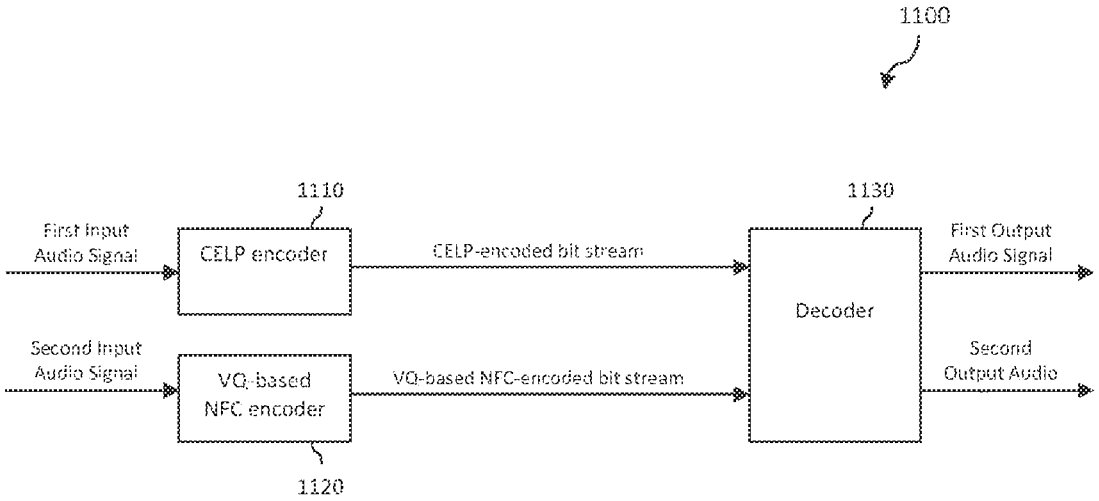
FIG. 11 depicts a system in accordance with an embodiment of the present invention in which a single decoder is used to decode a CELP-encoded bit stream as well as a VQ-based NFC-encoded bit stream.

In particular, FIG. 11 depicts a system 1100 in accordance with an embodiment of the present invention in which a single decoder 1130 is used to decode a CELP-encoded bit stream transmitted by a CELP encoder 1110 as well a VQ-based NFC-encoded bit stream transmitted by a VQ-based NFC encoder 1120. The operation of system 1100 of FIG. 11 will now be further described with reference to flowchart 1200 of FIG. 12.

Figure 12:
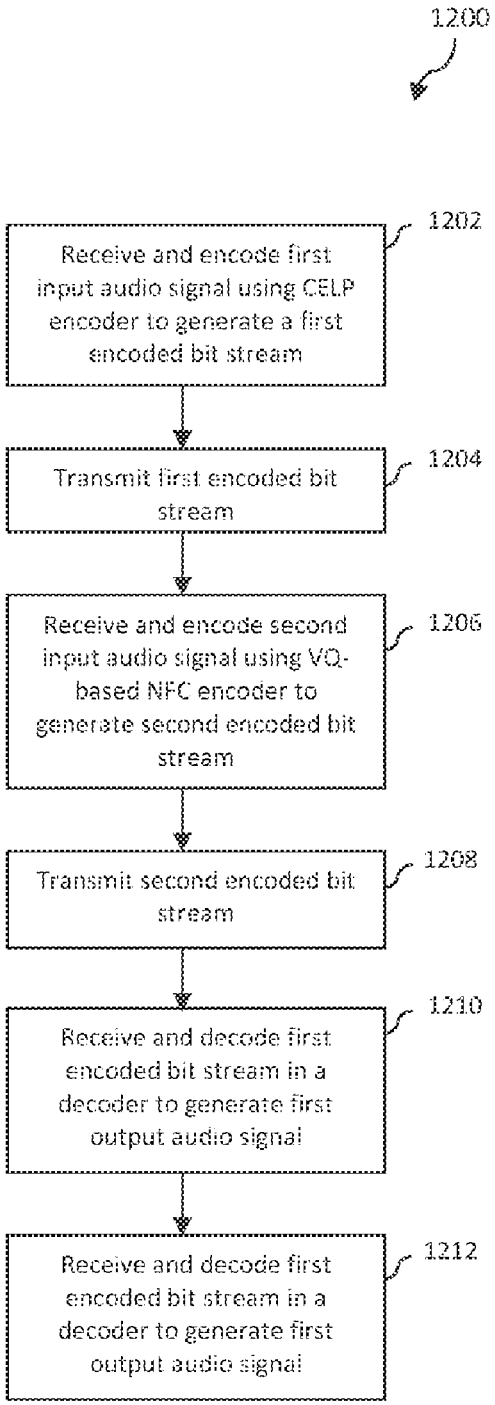
FIG. 12 is a flowchart of a method for communicating audio signals, such as speech signals, in accordance with a further alternate embodiment of the present invention.

As shown in FIG. 12, the method of flowchart 1200 begins at step 1202 in which CELP encoder 1110 receives and encodes a first input audio signal, such as a first speech signal, to generate a first encoded bit stream. At step 1204, CELP encoder 1110 transmits the first encoded bit stream to decoder 1130. At step 1206, VQ-based NFC encoder 1120 receives and encodes a second input audio signal, such as a second speech signal, to generate a second encoded bit stream. At step 1208, VQ-based NFC encoder 1120 transmits the second encoded bit stream to decoder 1130.

At step 1210, decoder 1130 receives and decodes the first encoded bit stream to generate a first output audio signal, such as a first output speech signal. At step 1212, decoder 1130 also receives and decodes the second encoded bit stream to generate a second output audio signal, such as a second output speech signal. Decoder 1130 is thus capable of decoding both CELP-encoded and VQ-based NFC-encoded bit streams.

D. Example Hardware and Software Implementations

Figure 13:
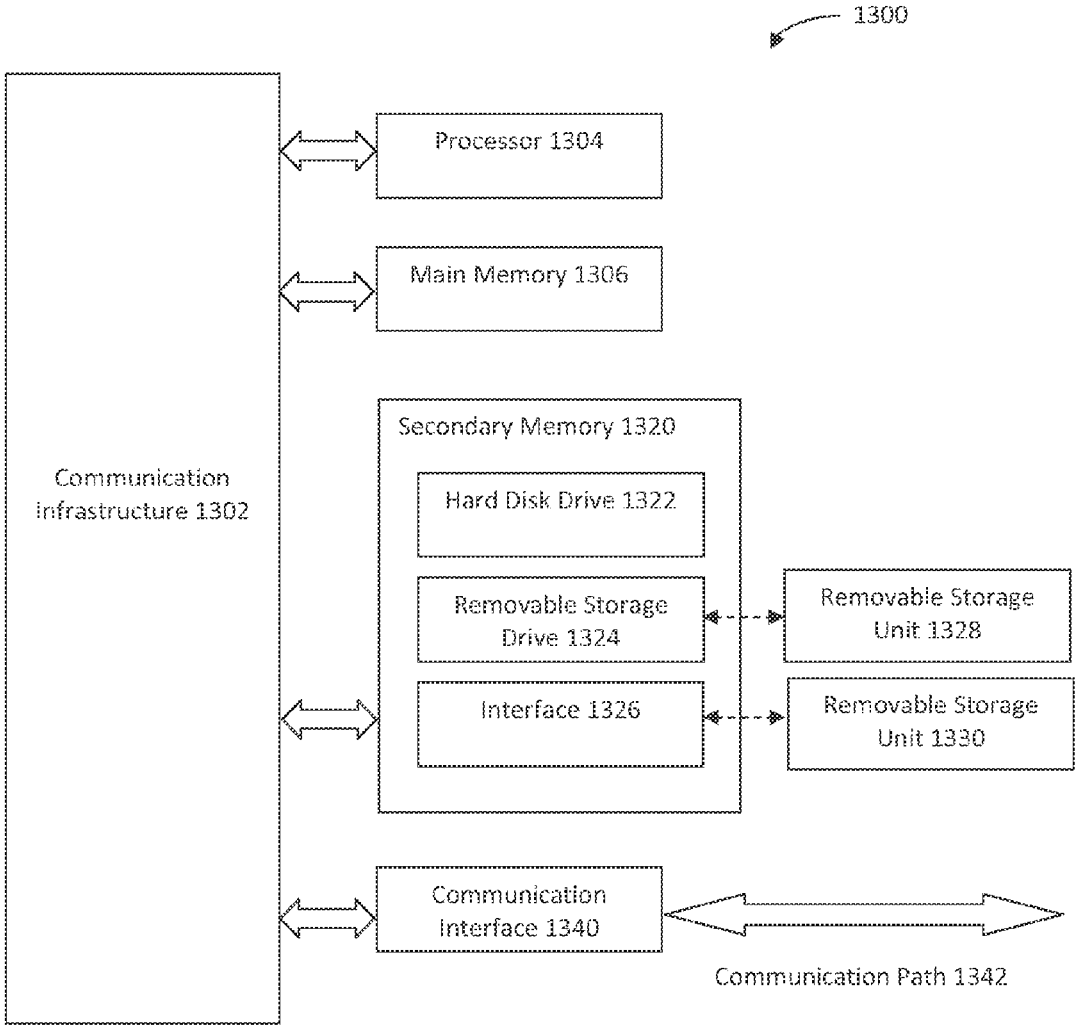
FIG. 13 is a block diagram of a computer system that may be used to implement the present invention.

The following description of a general purpose computer system is provided for the sake of completeness. The present invention can be implemented in hardware, or as a combination of software and hardware. Consequently, the invention may be implemented in the environment of a computer system or other processing system. An example of such a computer system 1300 is shown in FIG. 13. In the present invention, all of the processing blocks or steps of FIGS. 2 and 4-12, for example, can execute on one or more distinct computer systems 1300, to implement the various methods of the present invention. The computer system 1300 includes one or more processors, such as processor 1304. Processor 1304 can be a special purpose or a general purpose digital signal processor. The processor 1304 is connected to a communication infrastructure 1302 (for example, a bus or network). Various software implementations are described in terms of this exemplary computer system. After reading this description, it will become apparent to a person skilled in the relevant art(s) how to implement the invention using other computer systems and/or computer architectures.

Computer system 1300 also includes a main memory 1306, preferably random access memory (RAM), and may also include a secondary memory 1320. The secondary memory 1320 may include, for example, a hard disk drive 1322 and/or a removable storage drive 1324, representing a floppy disk drive, a magnetic tape drive, an optical disk drive, or the like. The removable storage drive 1324 reads from and/or writes to a removable storage unit 1328 in a well known manner. Removable storage unit 1328 represents a floppy disk, magnetic tape, optical disk, or the like, which is read by and written to by removable storage drive 1324. As will be appreciated, the removable storage unit 1328 includes a computer usable storage medium having stored therein computer software and/or data.

In alternative implementations, secondary memory 1320 may include other similar means for allowing computer programs or other instructions to be loaded into computer system 1300. Such means may include, for example, a removable storage unit 1330 and an interface 1326. Examples of such means may include a program cartridge and cartridge interface (such as that found in video game devices), a removable memory chip (such as an EPROM, or PROM) and associated socket, and other removable storage units 1330 and interfaces 1326 which allow software and data to be transferred from the removable storage unit 1330 to computer system 1300.

Computer system 1300 may also include a communications interface 1340. Communications interface 1340 allows software and data to be transferred between computer system 1300 and external devices. Examples of communications interface 1340 may include a modem, a network interface (such as an Ethernet card), a communications port, a PCMCIA slot and card, etc. Software and data transferred via communications interface 1340 are in the form of signals which may be electronic, electromagnetic, optical, or other signals capable of being received by communications interface 1340. These signals are provided to communications interface 1340 via a communications path 1342. Communications path 1342 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 1328 and 1330, a hard disk installed in hard disk drive 1322, and signals received by communications interface 1340. These computer program products are means for providing software to computer system 1300.

Computer programs (also called computer control logic) are stored in main memory 1306 and/or secondary memory 1320. Computer programs may also be received via communications interface 1340. Such computer programs, when executed, enable the computer system 1300 to implement the present invention as discussed herein. In particular, the computer programs, when executed, enable the processor 1300 to implement the processes of the present invention, such as any of the methods described herein. Accordingly, such computer programs represent controllers of the computer system 1300. Where the invention is implemented using software, the software may be stored in a computer program product and loaded into computer system 1300 using removable storage drive 1324, interface 1326, or communications interface 1340.

In another embodiment, features of the invention are implemented primarily in hardware using, for example, hardware components such as Application Specific Integrated Circuits (ASICs) and gate arrays. Implementation of a hardware state machine so as to perform the functions described herein will also be apparent to persons skilled in the relevant art(s).

E. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention.

For example, the present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for decoding an audio signal, comprising:
receiving an encoded bit stream, wherein the encoded bit stream represents an input audio signal encoded by a Code Excited Linear Prediction (CELP) encoder and is output by the CELP encoder; and
decoding the encoded bit stream using a vector quantization (VQ) based noise feedback coding (NFC) decoder to generate an output audio signal;
wherein at least one of the receiving and decoding steps is performed by one or more processors or integrated circuits.

2. The method of claim 1, wherein the input audio signal comprises an input speech signal and the output audio signal comprises an output speech signal.

3. The method of claim 1, wherein decoding the encoded bit stream using a VQ-based NFC decoder comprises decoding the encoded bit stream using a VQ-based two stage NFC decoder.

4. The method of claim 1, further comprising:
receiving the input audio signal; and
encoding the input audio signal using a CELP encoder to generate the encoded bit stream.

5. A system for communicating an audio signal, comprising:
one or more processors;
a Code Excited Linear Prediction (CELP) encoder configured to encode an input audio signal to generate an encoded bit stream when executed by the one or more processors; and
a vector quantization (VQ) based noise feedback coding (NFC) decoder configured to decode the encoded bit stream to generate an output audio signal.

6. The system of claim 5, wherein the input audio signal comprises an input speech signal and the output audio signal comprises an output speech signal.

7. The system of claim 5, wherein the VQ-based NFC decoder comprises a VQ-based two-stage NFC decoder.

8. A method for decoding an audio signal, comprising:
receiving an encoded bit stream, wherein the encoded bit stream represents an input audio signal encoded by a vector quantization (VQ) based noise feedback coding (NFC) encoder and is output by the VW-based NFC encoder; and
decoding the encoded bit stream using a Code Excited Linear Prediction (CELP) decoder to generate an output audio signal;
wherein at least one of the receiving and decoding steps is performed by one or more processors or integrated circuits.

9. The method of claim 8, wherein the input audio signal comprises an input speech signal and the output audio signal comprises an output speech signal.

10. The method of claim 8, wherein the encoded bit stream represents an input audio signal encoded by a VQ-based two-stage NFC encoder.

11. The method of claim 8, further comprising:
receiving the input audio signal; and
encoding the input audio signal using a VQ-based NFC encoder to generate the encoded bit stream.

12. A system for communicating an audio signal, comprising:
one or more processors;
a vector quantization (VQ) based noise feedback coding (NFC) encoder configured to encode an input audio signal to generate an encoded bit stream when executed by the one or more processors; and
a Code Excited Linear Prediction (CELP) decoder configured to decode the encoded bit stream to generate an output audio signal.

13. The system of claim 12, wherein the input audio signal comprises an input speech signal and wherein the output audio signal comprises an output speech signal.

14. The system of claim 12, wherein the VQ-based NFC encoder comprises a VQ-based two-stage NFC encoder.

15. A method for decoding audio signals, comprising:
receiving a first encoded bit stream, wherein the first encoded bit stream represents a first input audio signal encoded by a Code Excited Linear Prediction (CELP) encoder and is output by the CELP encoder;
decoding the first encoded bit stream in a decoder to generate a first output audio signal;
receiving a second encoded bit stream, wherein the second encoded bit stream represents a second input audio signal encoded by a vector quantization (VQ) based noise feedback coding (NFC) encoder and is output by the VQ-based NFC encoder; and decoding the second encoded bit stream in the decoder to generate a second output audio signal;

wherein at least one of the receiving and decoding steps is performed by one or more processors or integrated circuits.

16. The method of claim 15, wherein the first and second input audio signals comprise input speech signals and wherein the first and second output audio signals comprise output speech signals.

17. The method of claim 15, wherein the second encoded bit stream represents a second input audio signal encoded by a VQ-based two-stage NFC encoder.

18. A system for communicating audio signals, comprising:

one or more processors;

a Code Excited Linear Prediction (CELP) encoder configured to encode a first input audio signal to generate a first encoded bit stream when executed by the one or more processors;

a vector quantization (VQ) based noise feedback coding (NFC) encoder configured to encode a second input audio signal to generate a second encoded bit stream; and a decoder configured to decode the first encoded bit stream to generate a first output audio signal and to decode the second encoded bit stream to generate a second output audio signal.

19. The system of claim 18, wherein the first and second input audio signals comprise input speech signals and wherein the first and second output audio signals comprises output speech signals.

20. The system of claim 18, wherein the VQ-based NFC encoder comprises a VQ-based two-stage NFC encoder.

* * * * *